US005503136A

United States Patent [19]

Tone

[11] Patent Number: 5,503,136

[45] Date of Patent: Apr. 2, 1996

[54] ARROW REST WITH RETRACTING ARM

[75] Inventor: Richard D. Tone, Gilbert, Ariz.

[73] Assignee: Cavalier Equipment Company, Inc., Gilbert, Ariz.

[21] Appl. No.: 235,664

[22] Filed: Apr. 29, 1994

[51] Int. Cl.[6] ..... F41B 5/22

[52] U.S. Cl. ..... 124/44.5

[58] Field of Search ..... 124/24.1, 44.5

[56] References Cited

U.S. PATENT DOCUMENTS

| | | | |
|---|---|---|---|
| 2,691,974 | 10/1954 | Nelson | 124/44.5 |
| 2,743,716 | 5/1956 | Wendt | 124/44.5 |
| 3,504,659 | 4/1970 | Babington . | |
| 3,769,956 | 11/1973 | Simo | 124/44.5 |
| 3,871,352 | 3/1975 | Stanislawski . | |
| 4,287,868 | 9/1981 | Schiff | 124/44.5 |
| 4,343,286 | 8/1982 | Thacker . | |
| 4,344,409 | 8/1982 | Barner | 124/24.1 |
| 4,473,058 | 9/1984 | Terry . | |
| 4,489,704 | 12/1984 | Troncoso, Jr. . | |
| 4,548,188 | 10/1985 | Simo . | |
| 4,548,189 | 10/1985 | Pietraszek et al. . | |
| 4,579,101 | 4/1986 | Bateman, III . | |
| 4,592,332 | 6/1986 | Topping . | |
| 4,676,220 | 6/1987 | Pietraszek | 124/44.5 |
| 4,715,355 | 12/1987 | Lattig | 124/44.5 |
| 4,803,971 | 2/1989 | Fletcher | 124/44.5 |
| 4,827,895 | 5/1989 | Troncoso | 124/44.5 |
| 4,865,007 | 9/1989 | Saunders | 124/24.1 X |
| 4,907,566 | 3/1990 | Klein | 124/44.5 |
| 4,949,699 | 8/1990 | Gerber | 124/44.5 |
| 4,953,521 | 9/1990 | Troncoso et al. | 124/24.1 |
| 5,009,215 | 4/1991 | Ludwig | 124/44.5 |
| 5,107,818 | 4/1992 | Simo . | |
| 5,150,700 | 9/1992 | Troncoso | 124/44.5 |
| 5,179,930 | 1/1993 | Simo | 124/44.5 |

*Primary Examiner*—John A. Ricci
*Attorney, Agent, or Firm*—Cahill, Sutton & Thomas

[57] ABSTRACT

An arrow rest for attachment to a bow includes a bracket assembly having a first portion adapted for attachment to the bow and a second portion supporting a generally horizontal pivotal rest arm adapted to support a shaft of an arrow. The rest arm has a free end extending upward to engage a side portion of the arrow. A generally vertical pivot pin extends through the second portion of the bracket and is attached to a second end of the rest arm to allow the rest arm to pivot. A pivotal magnet support is rigidly connected to the pivot pin, and a magnet is connected rigidly to the magnet support. A magnetic material is connected in fixed relationship to the rest arm, the magnetic material having its magnetic poles oriented to bias the rest arm so as to urge its free first end toward a side of a window of the bow. Alternate embodiments include a spring biased arrangement and a weight biased arrangement.

9 Claims, 2 Drawing Sheets

ARROW REST WITH RETRACTING ARM

BACKGROUND OF THE INVENTION

The invention relates to an arrow support mechanism including an arrow rest arm that is magnetically-, weight-, or spring-biased inward toward the side of the bow window so as to be retracted out of the path of a vane of the arrow just after it is released. The inwardly biased rest arm is released by bowing of the arrow instantly after its release.

Referring to FIG. 1, it is well known that striking of an arrow rest arm by a vane of an arrow 16 causes a deflection of the rear end of an arrow 16, causing inaccuracy of the shot. Such deflection is problematically large with recent "high technology" carbon target arrows, which are much lighter than aluminum target arrows. Most of the weight of a carbon target arrow is located toward the metal tip of the arrow, and the trailing end is very light. Consequently, if the vane of a carbon target arrow strikes the arrow support arm 15, there is a much larger amount of deflection at the tail end than is the case for a typical aluminum target arrow. (Plastic vanes produce more consistent results than feather fletching.)

The closest prior art known to the inventor is U.S. Pat. No. 4,473,058 (Terry), which discloses an arrow rest structure similar to that of the present invention. In the Terry patent, a magnet 39 biases the rest arm 29 away from the bow handle, rather than toward it. Therefore, the Terry arrow rest does not function on the principle of automatic retraction of the rest arm before the vanes of the archery arrow 16 can strike it, but instead functions on the principle of very light weight and pivotability of the rest arm wire, so the rest arm pivots out of the way when struck by the vanes of the released arrow. This, of course, deflects the trailing end of the arrow, resulting in reduced accuracy of the shot. Furthermore, the magnet and the wire portion 41 of Terry initially are in contact, held in that configuration by a high magnetic force that is inversely proportional to the very small distance between them. A relatively high force on the rest arm by the vane of the released arrow therefore is necessary to break the magnetic contact and force the rest arm to pivot out of the way. This results in a large counterforce against the vane and a considerable deflection of the tail end of the released arrow.

Despite the large number of known arrow rests designed to decrease deflection of a released arrow, there remains an unmet need for a simple, economical arrow rest assembly which completely avoids deflection of an arrow by preventing the fletching or vanes of a released arrow from ever contacting the rest arm.

SUMMARY OF THE INVENTION

Accordingly, it is an object of the invention to provide an arrow rest and method that prevents any contact by a vane of a released arrow with a rest arm of an arrow rest.

It is another object of the invention to provide an economical, simple arrow rest structure that allows accurate grouping of lightweight carbon target arrows.

Briefly described, and in accordance with one embodiment thereof, the invention provides an arrow rest for attachment to a bow. The arrow rest includes a bracket having a first portion adapted for attachment to the bow. A generally horizontal rest arm adapted to support the shaft of an arrow is pivotally attached to a second portion of the bracket. A free first end of the rest arm extends upward, engaging the side of the arrow before it is released. A generally vertical pivot rod is attached to a second end of the rest arm, and extends through a bearing hole in the second portion. A first magnet is attached to a first magnet support which is rigidly connected to the pivot rod. A stationary second magnet support is attached to the second portion of the bracket. A second magnet is attached to the second magnet support. The magnetic poles of the first and second magnets are oriented so as to bias the rest arm away from the shaft of the arrow. In the described embodiment the first magnet support extends from the pivot rod in a direction away from the rest arm, and the first and second magnets are oriented so that opposite magnetic poles thereof are adjacent, whereby the force between them is attractive. In the described embodiment, the rest arm and the pivot rod are integral. In other embodiments, the bias force is produced by a spring or a weight.

DETAILED DESCRIPTION OF THE PREFERRED EMBODIMENTS

Figure 1:
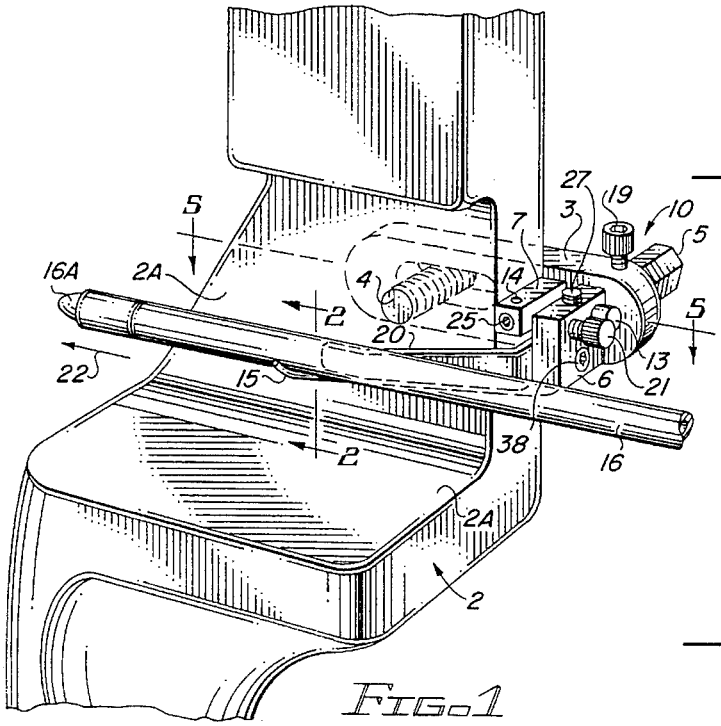
FIG. 1 is a partial perspective view illustrating the arrow rest of the present invention mounted on a bow handle, immediately prior to release of an arrow.

FIG. 1 shows a vertical bow handle 2 to which an arrow rest assembly 10 of the present invention is attached. Arrow rest assembly 10 includes a side attachment plate 3 attached to the bow handle 2 by a threaded bolt 4. A horizontal hex rod 5 extends through a hole in side plate 4 and is held in place by a set screw 19, which allows adjustment of the horizontal position of hex rod 5, and hence of rest arm 15.

A pivot block or first magnet support 7 is rigidly attached to and pivotly supported by the upper portion of a vertical pivot rod 14 that extends through a bearing hole in the left end of hex rod 5. Pivot block 7 carries a first cylindrical magnet 12, shown in FIG. 5. Set screw 25 in the end of pivot block 7 engages pivot rod 14, rigidly attaching pivot block 7 to rod 14 and hence to rest arm 15. A horizontal wire arrow support arm or rest arm 15 (preferably integral with pivot pin 14) is rigidly attached to the bottom of pivot rod 14. Rest arm 15 thus is rigidly connected to pivot block 7, so rotation of pivot block 7 therefore causes identical rotation of rest arm 15.

Figure 6:
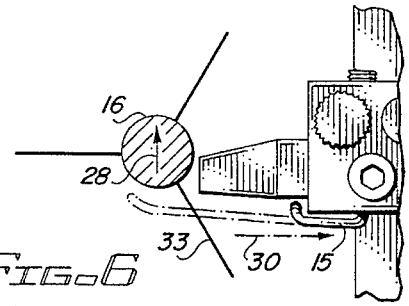
FIG. 6 is a partial right end elevation view of FIG. 1.
Figure 5:
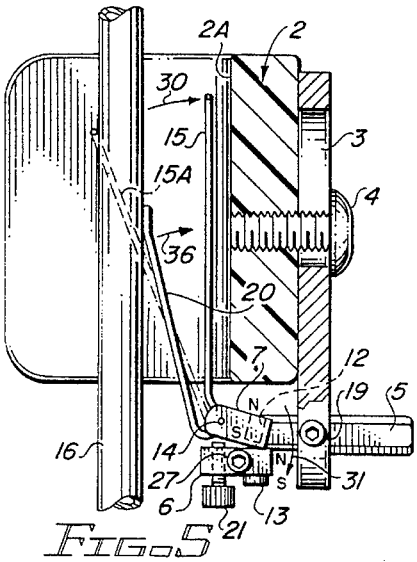
FIG. 5 is a section view along section line 5—5 of FIG. 1, modified to show the position of rest arm 15 after its retraction is complete.
Figure 3:
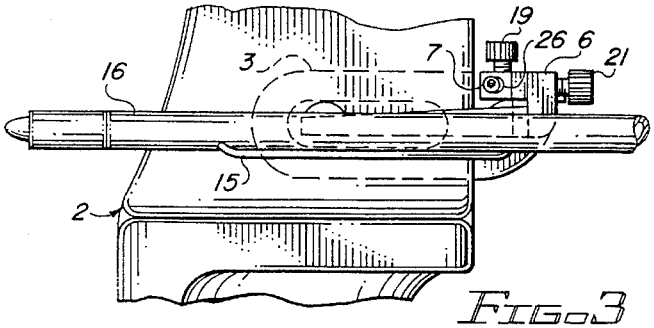
FIG. 3 is an elevation view useful in explaining the arrow rest configuration immediately before release of the arrow.

Before archery arrow 16 is released, the weight of its forward portion is supported on rest arm 15. The outer or free end of rest arm 15 is curved upward slightly to contact the lower outer side of the shaft of arrow 16. This prevents the subsequently described bias force from rotating or pivoting rest arm 15 in the direction of arrow 30, as shown in FIGS. 5 and 6, as long as arrow 16 actually is being supported by rest arm 15.

An elastic "spine point" arm 20 is rigidly attached in fixed relationship to hex rod 5. Arm 20 elastically yields inwardly in direction 36 as a result of inevitable sideways flexing of arrow 16 as it is released by the fingers of the archer and propelled forward by the bowstring (not shown). As is well known, this prevents undesirable sideways deflection of the arrow by the bow handle as a result of flexing of arrow 16 as it is released.

A stationary block or second magnet support 6 is attached by set screw 38 to hex rod 5. An adjustment screw 21 with a knurled handle extends through stationary block 6 and engages the adjacent face of pivot block 7 to limit the extent that rest arm 15 can swing outward away from bow handle face 2A (which also can be referred to as the side 2A of the bow window). A set screw 27 in the top surface of stationary block 6 retains a second cylindrical magnet 13 in a horizontal hole extending through pivot block 6. If set screw 27 is loosened, the position of magnet 13 can be adjusted. Or, magnet 13 can be removed and flipped 180 degrees so its magnetic poles are reversed, causing the magnet 12 (FIG. 5) supported in pivot block 7 to be repelled rather than attracted by magnet 13, to thereby bias rest arm 15 in the outward, rather than inward direction. (This can be advantageous in the opinion of some users who, for reasons unrelated to the present invention, prefer outward bias of the rest arm.)

In accordance with the present invention, opposite poles of magnets 12 and 13, separated by a gap, are adjacent to each other and therefore attract. The attractive force "biases" rest arm 15 inward from arrow 16, toward the face 2A of bow handle 2, in the direction of arrow 30 (FIG. 5).

In use, the archer, with arrow 16 notched in the bowstring, uses a finger to "flip" rest arm 15 from its initial inward position outward along bow handle face 2A, pivoting rest arm 15 against the bias force caused by magnets 12 and 13 into the position shown in FIG. 1. The weight of arrow 16 pressing downward on rest arm 15 and the upward bend of its free end holds rest arm 15 in that position until arrow 16 is released.

Figure 4:
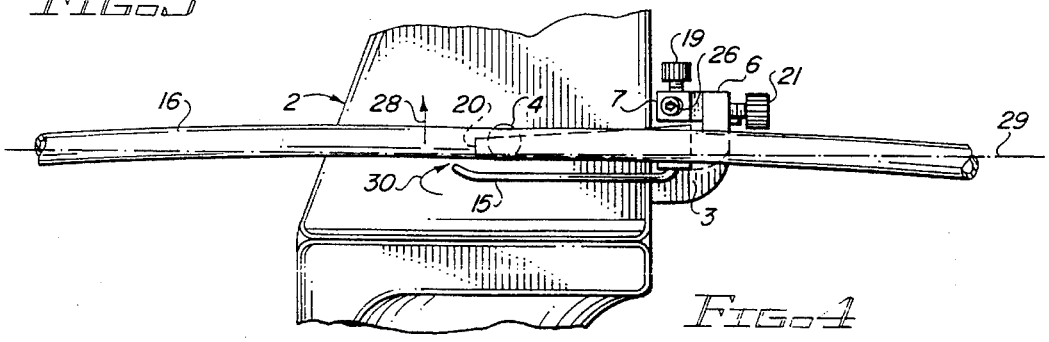
FIG. 4 is an elevation view useful in explaining the arrow rest immediately after the arrow has been released.

When arrow 16 is released by the archer's fingers (or by an automatic release device that archers now commonly use), it is propelled forward in direction 22. Oscillatory flexing of arrow 16 inevitably occurs, and by the time it has traveled about six inches, it bows upward as indicated by arrow 28 (FIGS. 4 and 6) and loses contact with rest arm 15. The attractive "bias force" between adjacent opposite magnetic poles of magnets 12 and 13 causes pivot block 12 to pivot in the direction of arrow 31, thereby causing rest arm 15 to rapidly pivot in direction 30, out of the path of the vane 33 attached to the rear end of arrow 16. (Vane 33 and the vane above it are positioned to avoid contact with spine point arm 20.) This automatic retraction of rest arm 15 out of the path of vane 33 in response to the inward bias of rest arm 15 produced by the attractive magnetic force between magnets 12 and 13 enables vane 33 to pass by bow handle without striking rest arm 15.

The rapidity with which rest arm 15 is retracted is a result of a rapid increase in the attractive force between opposite poles of magnets 12 and 13 as the distance between them decreases while pivot block 7 rotates in the direction of arrow 31. The attractive force is inversely proportional to the length of the gap between the adjacent opposing poles of magnets 12 and 13, and therefore causes a much greater acceleration of rest arm 15 in direction 30 than would be the case if a spring or elastic member were used to produce the inward biasing force on rest arm 15. In the later case, the biasing force would decrease, not increase as rest arm 15 moves in direction 30.

Figure 2:
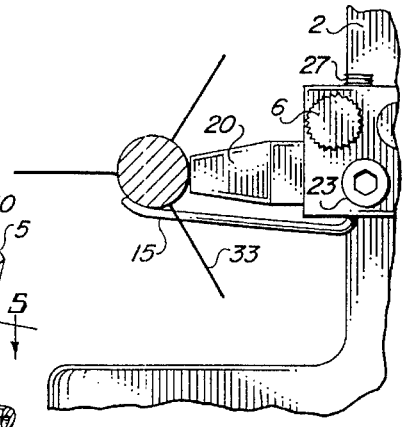
FIG. 2 is a section view taken along section line 2—2 of FIG. 1, additionally showing vanes of the arrow.

I have taken sequential high speed photographs which conclusively show that in the above described embodiment of the invention, rest arm 15 is retracted from the position shown in FIG. 1 all the way back to the position against bow handle 2 as shown in FIG. 5 before the vane 33 of FIG. 2 reaches bow handle 2 and the original location of rest arm 15. Therefore, there is no possibility of vane 33 striking rest arm 15 and deflecting the arrow 16.

Figure 7:
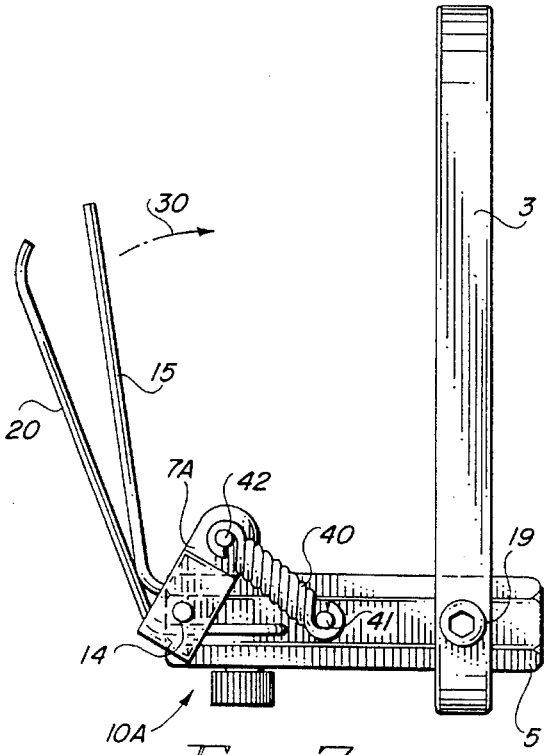
FIG. 7 is a section view similar to FIG. 5 illustrating an alternate embodiment of the invention wherein the inward bias force on rest arm 15 is produced by a spring 40.

Referring now to an alternate embodiment of the invention shown in FIG. 7, magnets 12 and 13 are omitted, and instead a tension spring 40 is connected by its opposite ends between a stationary pin 41 attached to the top of hex rod 5 and a pin or connection 42 on a forward end of a modified pivot block 7A. As in FIGS. 1–5, pivot block 7A is rigidly attached to a pivot rod 14 which extends downward through a bearing hole in the left end of hex rod 5. Rest arm 30 is thereby biased in the direction of arrow 30. Pivot rod 14 preferably is integral with rest arm 15.

Figure 8:
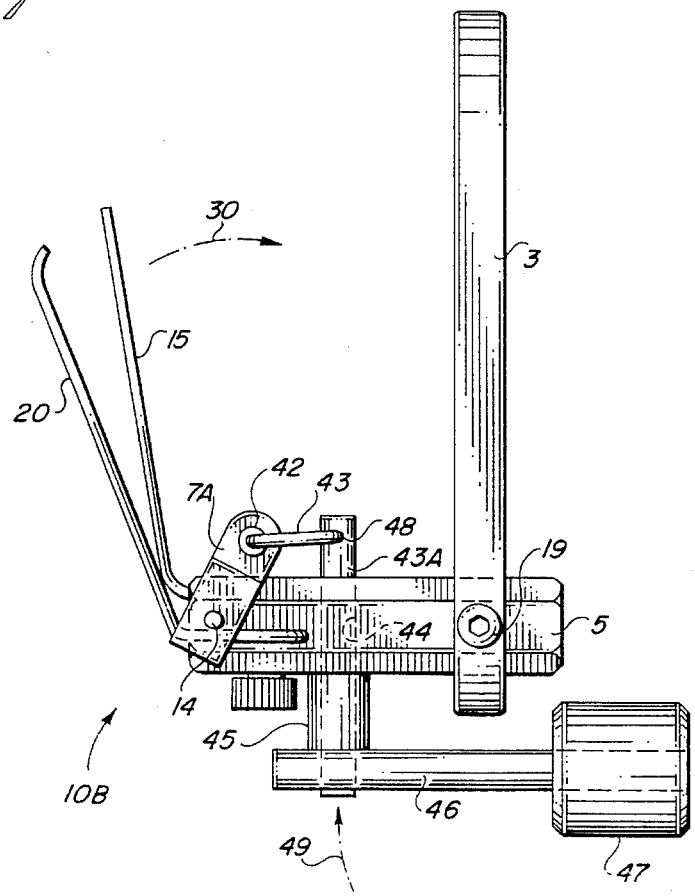
FIG. 8 is a diagram similar to FIG. 7 wherein the inward bias on rest arm 15 is produced by a weight and linkage mechanism.

FIG. 8 shows another embodiment similar to that of FIG. 7, wherein spring 40 is replaced by a weight and linkage assembly including a link arm 43 having its left end pivotly connected at connection 42 to the forward end of pivot block 7A. The right end of link arm 43 is connected to a vertical pin 48 or the like rigidly attached to a horizontal rotational shaft 43A that extends through clearance hole 44 in hex rod 5. The rear end of shaft 43A passes through a spacer 45 and is connected to the left end of a horizontal arm 46. A weight 47 is attached to the right end of arm 46, so the downward force of weight 47 on arm 46 tends to rotate rod 43A clockwise, as viewed from the direction indicated by arrow 49. This causes shaft 43A to tend to rotate pivot block 7A about pivot rod 14 so as to cause the outer end of rest arm 15 to move in the direction of arrow 30.

While the invention has been described with reference to several particular embodiments thereof, those skilled in the art will be able to make the various modifications to the described embodiments of the invention without departing from the true spirit and scope of the invention. It is intended that all combinations of elements and steps which perform substantially the same function in substantially the same way to achieve the same result are within the scope of the invention. For example, the first magnet 12 could be integral with or directly attached to a portion of rest arm 15. Magnet 12 could be on the same side of pivot rod 14 as rest arm 15 rather than on the opposite side if the polarity of the magnetic poles of one of the two magnets is reversed to cause a repelling rather than attractive force between them. Another alternative is to use only one magnet, which is stationary, with the rest arm including magnetic material and the pivot and stationary magnet placed to bias the rest arm 15 inward toward bow handle 2, rather than away from it as in the Terry patent. (The term "magnetic material" is intended to include any material attracted by a magnet.)

What is claimed is:

1. An arrow rest for attachment to a bow, comprising in combination:

(a) a bracket having a first portion adapted for attachment to the bow;

(b) a generally horizontal pivotal rest arm adapted for supporting a shaft of an arrow, the rest arm having a free first end extending upward to engage a side of the arrow;

(c) a generally vertical pivot rod attached to a second end of the rest arm adapted to allow pivoting of the rest arm, the bracket having a second portion adapted for supporting the pivot rod in a fixed location;

(d) a pivotal first magnet support connected to the pivot rod, and a first magnet rigidly connected to the first magnet support; and (e) a stationary second magnet support connected in fixed relationship to the second portion of the bracket, and a second magnet rigidly connected to the second magnet support, the first and second magnets having their respective magnetic poles oriented to cause an attractive force therebetween to bias the rest arm so as to urge its free first end away from the shaft of the arrow toward a side of a window of the bow.

2. The arrow rest of claim 1 wherein the first magnet support extends from the pivot rod in a direction away from the rest arm, and the first and second magnets are oriented so that opposite magnetic poles thereof are adjacent.

3. The arrow rest of claim 1 wherein the rest arm and the pivot rod are integral, the pivot rod extending upward through a vertical bearing hole in the second portion of the bracket and extending through a hole in the first magnetic support, a first set screw securing the first magnet support to the pivot rod.

4. The arrow rest of claim 3 wherein the second portion of the bracket is adjustably connected to the first portion and extends horizontally at a right angle therefrom.

5. The arrow rest of claim 3 including a second set screw in the second magnet support adapted to allow adjustment of the position of the second magnet to adjust the bias or to allow the positions of the magnetic poles of the second magnet to be reversed.

6. The arrow rest of claim 3 wherein the rest arm and the pivot rod are composed of a single piece of stiff wire material.

7. An arrow rest for attachment to a bow, comprising in combination:

(a) a bracket having a first portion adapted for attachment to the bow;

(b) a generally horizontal pivotal rest arm adapted for supporting a shaft of an arrow, the rest arm having a free first end extending upward to engage a side of the arrow;

(c) a generally vertical pivot rod attached to a second end of the rest arm adapted to allow pivoting of the rest arm, the bracket having a second portion adapted for supporting the pivot rod in a fixed location;

(d) a stationary magnet support connected in fixed relation to the second portion of the bracket, and a magnet rigidly connected to the stationary magnet support; and (e) magnetic material connected in fixed relationship to the rest arm, the magnet having its magnetic poles oriented to cause magnetic force thereof acting on the magnetic material to bias the rest arm so as to urge its free first end away from the shaft of the arrow toward a side of a window of the bow.

8. An arrow rest for attachment to a bow, comprising in combination:

(a) a bracket having a first portion adapted for attachment to the bow;

(b) a generally horizontal pivotal rest arm adapted for supporting a shaft of an arrow, the rest arm having a free first end extending upward to engage a side of the arrow;

(c) a generally vertical pivot rod attached to a second end of the rest arm adapted to allow pivoting of the rest arm, the bracket having a second portion adapted for supporting the pivot rod in a fixed location;

(d) a pivotal arm attached to the pivot rod;

(e) a spring in an elastically deformed condition having a first end engaging the bracket and a second end engaging an end portion of the pivotal arm to bias the rest arm so as to urge its free end away from the shaft of the arrow toward a side of a window of the bow in response to deformation of the spring.

9. An arrow rest for attachment to a bow, comprising in combination:

(a) a bracket having a first portion adapted for attachment to the bow;

(b) a generally horizontal pivotal rest arm adapted for supporting a shaft of an arrow, the rest arm having a free first end extending upward to engage a side of the arrow;

(c) a generally vertical pivot rod attached to a second end of the rest arm adapted to allow pivoting of the rest arm, the bracket having a second portion adapted for supporting the pivot rod in a fixed location;

(d) a pivotal arm attached to the pivot rod;

(e) a weight attached to a generally horizontal crank arm;

(f) a rotational arm connected to the generally horizontal crank arm and journaled in the second portion of the bracket; and (g) a linkage connected between the rotational arm and the pivotal arm so as to urge a free end of the pivotal arm away from the shaft of the arrow toward a side of a window of the bow in response to downward force of gravity on the weight.

* * * * *